US006191700B1

(12) United States Patent
Cardona

(10) Patent No.: US 6,191,700 B1
(45) Date of Patent: Feb. 20, 2001

(54) LUMINOUS SIGNS WITH SEQUENTIAL VARIATION OF IMAGES

(75) Inventor: Fabio Rafael Duque Cardona, Medellin (CO)

(73) Assignee: Visual Masters S.A., Medellin (CO)

( * ) Notice: Under 35 U.S.C. 154(b), the term of this patent shall be extended for 0 days.

(21) Appl. No.: 09/315,936

(22) Filed: May 21, 1999

(51) Int. Cl.[7] ..... G09F 13/12

(52) U.S. Cl. ..... 340/815.55; 340/815.87; 40/436; 40/466

(58) Field of Search ..... 340/815.55, 815.56, 340/815.73, 815.74, 815.77, 815.83, 815.86, 815.87, 815.89; 40/427, 429, 436–438, 463, 466, 470, 494

(56) References Cited

U.S. PATENT DOCUMENTS 3,277,597 * 10/1966 Trame ..... 40/106.53
3,742,631 * 7/1973 Hasala ..... 40/106.53
3,747,243 * 7/1973 Schneider ..... 40/30
3,862,504 * 1/1975 Ringelheim et al. ..... 40/106.53
3,883,966 * 5/1975 Ludwig ..... 40/36
3,918,185 * 11/1975 Hasala ..... 40/106.53
4,092,791 * 6/1978 Apissomian ..... 40/470
4,246,713 * 1/1981 Eckert ..... 40/437
4,897,802 * 1/1990 Atkinson et al. ..... 364/518
5,440,214 * 8/1995 Peeters ..... 318/685
5,488,791 * 2/1996 Boni ..... 40/467
5,513,458 * 5/1996 Dehli ..... 40/470
5,783,919 * 7/1998 Dehli et al. ..... 318/466

* cited by examiner

*Primary Examiner*—Jeffery A. Hofsass
*Assistant Examiner*—Sihong Huang
(74) *Attorney, Agent, or Firm*—Smith Gambrell & Russell, LLP

(57) ABSTRACT

Luminous signs, specifically those with the ability to change the presented information sequentially, include an electromechanical system that produces the synchronized overlapping of two or more preprinted films with translucent properties, in such a way that with an internal luminous source, the sign is capable of creating the effect of real movement, and in the night or in the darkness, the information images displayed by the sign seem to float in the air. The present invention also provides an illuminated sign with the capability of displaying such information or images on more than one of its surfaces.

15 Claims, 9 Drawing Sheets

LUMINOUS SIGNS WITH SEQUENTIAL VARIATION OF IMAGES

FIELD OF THE INVENTION

This invention relates to the field of luminous signs, specifically those with the ability to change the presented information sequentially and create the effect of real movement of the displayed images.

BACKGROUND OF THE INVENTION

As is well known, the field of visual information by means of luminous or illuminated signs has quickly evolved into what we now know as electronic signs. However, still utilized are the simple, static, generally singled-faced signs that always show the same information. Then there are the signs which use prisms with a printed part of the final image in each face, those prisms rotate sequentially to show generally three static scenes, as the simple signs. Also, there are the signs which use a single preprinted film in a belt form, moved by an electric motor and a set of rollers, with at least two different static scenes, which are also shown sequentially.

Sometimes the above signs are interiorly illuminated, depending on the translucent properties of the material used to make the sign.

Then, there are neon or bulb signs which create the sense of movement and variation of the information shown, without achieving real images.

Another display device for sequentially displaying multiple sets of image pixels formed on a transparent mosaic through an aperture pattern formed in a substantially opaque mask is disclosed in U.S. Pat. No. 5,783,919 to Dehli, et al. The device uses an AC gear motor and a drive assembly to move a mosaic through a predetermined travel path relative to a mask to sequentially register image sets with an aperture pattern. This device displays; and static high resolution images without achieving a sense of movement.

It is therefore our intention to fill this gap between neon signs and electronic signs with the present invention.

Another objective of the present invention is to create a sign in which the exterior frame does not produce a negative effect in the final aspect of the sign. Another objective of the present invention, is to create a visual effect in which in the night, or in the darkness, the frame and the background of the sign cannot be seen so that the information or the images shown in the sign seems to be floating in the air.

In yet another aspect, the invention provides an illuminated sign with the ability to display the information on more than one of its sides.

BRIEF DESCRIPTION OF THE INVENTION

The present invention consists of an electromechanical system that produces synchronized movement of two or more films of any shape, with some sort of preprinted information, of any translucent material, in such a way that the overlapping of these films, thanks to the movement of the electromechanical system, produces the effect of real movement, or a sequential change of information.

Because of the black background and frame of the sign, when it is exposed in the night or in a dark space, the information or the images shown in it seem to be floating in the air. Such set up consists basically of a support frame, a conventional luminous source placed within the sign, two or more preprinted films, one or more motors, rollers and movement transfer mechanisms such as chains or belts.

The final objective is to show a scene in real movement, using any of the gamut of colors in existence, which can be visualized in its entirety thanks to translucent properties of the material used to make the films, and the source of interior light.

The system can be used in such a manner so that it is possible to show the same or different effects in the front, rear and lateral sides of the sign.

A more complete understanding of the present invention, its objectives, aspects, and advantages will be reached when the present description is read in conjunction with the following drawings.

DESCRIPTION OF THE PREFERRED EMBODIMENT

Figures 1A, 1B, 1C:
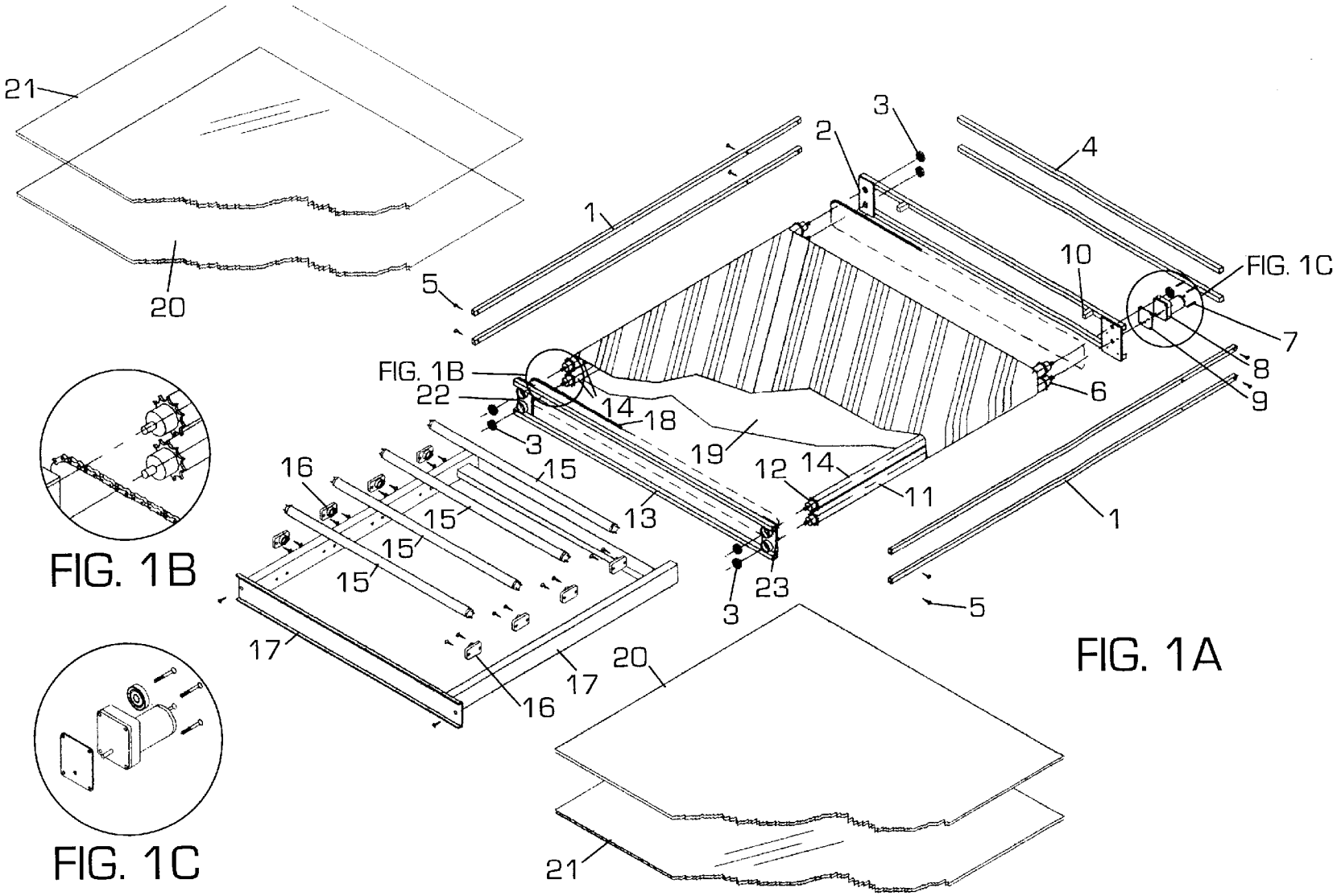
FIGS. 1A–1C show a top exploded view of the preferred embodiment of a luminous sign of the present invention.
Figure 2:
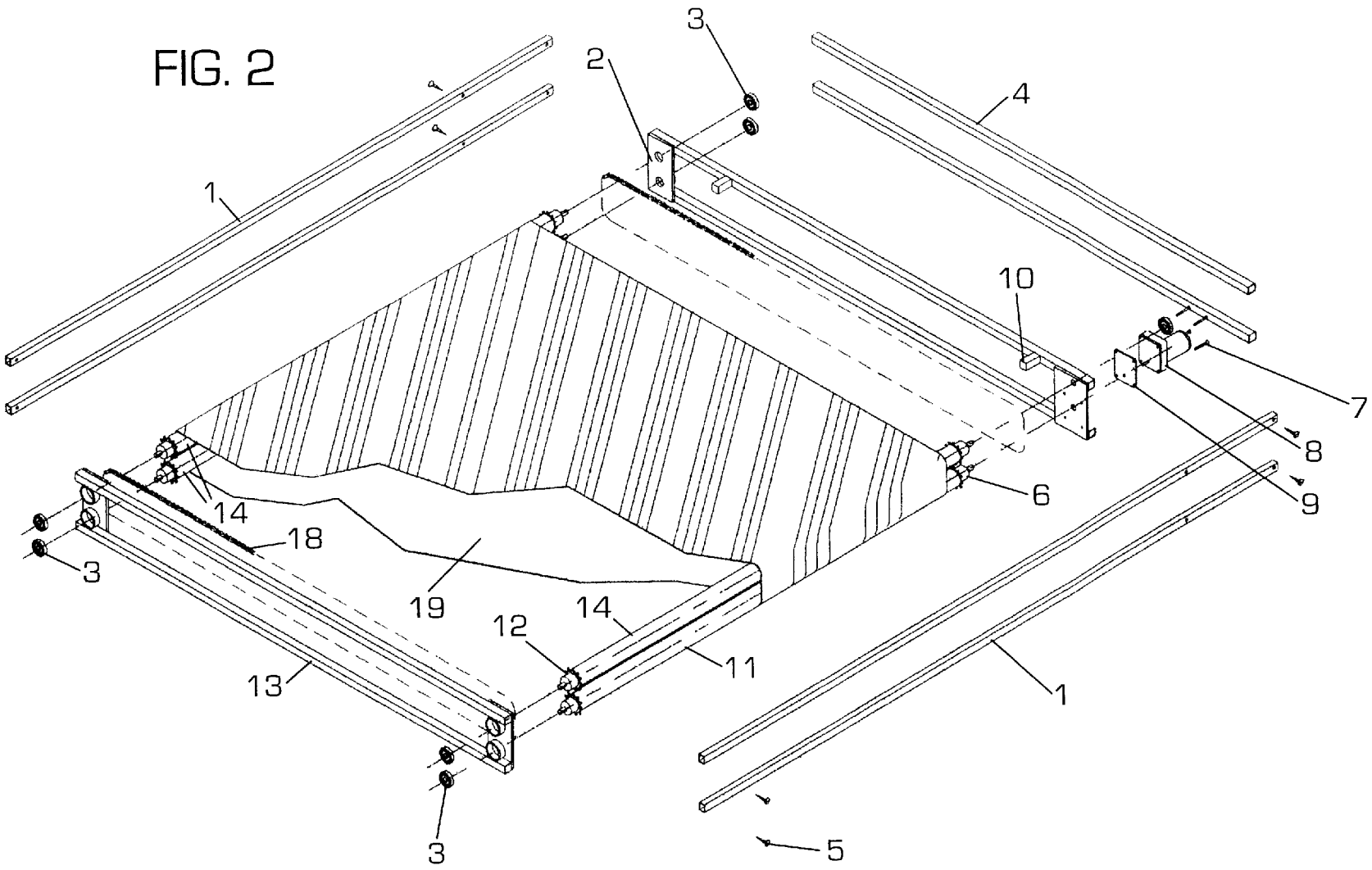
FIG. 2 shows a top view of the frame, films and electromechanical system of the preferred embodiment of the invention.

FIGS. 1A–1C show the exploded assembly of the preferred embodiment of the present invention in which the two lateral structures (1), where each one consists preferably of two tubular elements, attach the bottom frame (2), and the top frame (13), by means of any mechanical attachment, such as screws (5), welding, bolts, or rivets. Said lateral structures (1), in conjunction with the bottom frame (2), and the top frame (13), comprise the main frame and give general resistance to the sign of the preferred embodiment of the present invention. Said bottom frame (2), and top frame (13), each have four bearings (3), mounted on the affixed plate (23), or on the movable plate (22), which is also used as a tempering element. These four bearings are enough in this embodiment to mount the drag roller (11), which gives motion to the preprinted film (19), and the other three free rollers (14), which stretch out the preprinted film (19) in the form of a belt of the preferred embodiment of the present invention.

It is to be noted, that the preprinted film (19) may have any other presentation, in order to replace the belt form (i.e. a rotating disk), or there may be more than one preprinted film, and each one may have a different shape, or the same, depending on the desired sequence of images.

Figure 4:
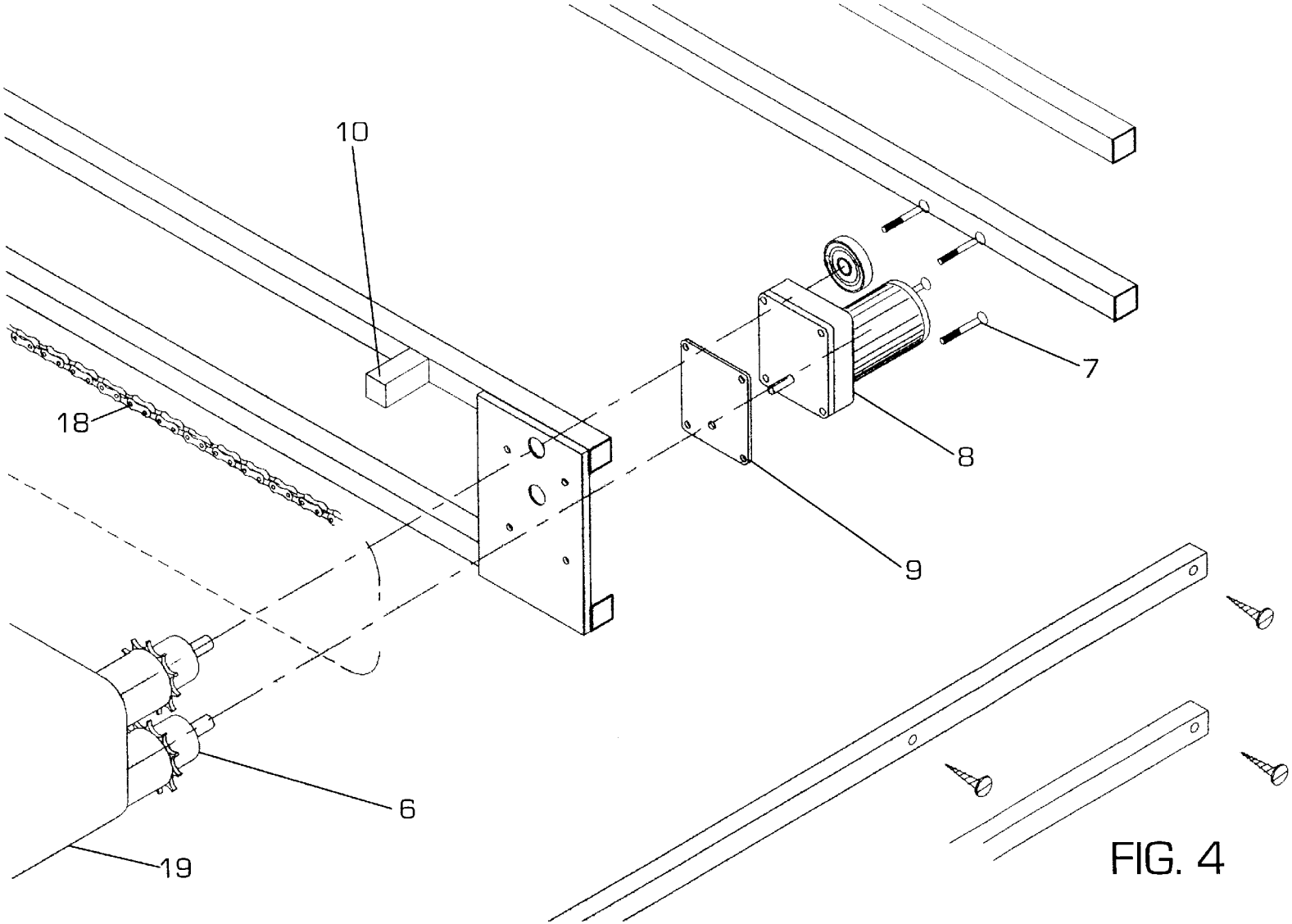
FIG. 4 shows the assembly of the electric motor with the drag roller of the preferred embodiment of the present invention.

The electric motor (8), shown in FIG. 4, is affixed to the drag roller by means of any type of axle housing (6), coupler, etc. The electric motor could be a simple one, or a servomotor, and the complete electromechanical system may be self controlled or it may be controlled (108, 109) by means of a computer (107). In the embodiment shown in FIG. 4, the motor (8) is affixed to the bottom frame, by means of screws (7), and in between those two elements a rubber gasket (9) is used.

In order to keep the mechanism synchronized, in the preferred embodiment shown in FIG. 4, it is necessary to use a chain (18) bonded to the border of the preprinted film, and pinions (12) at the same end of the rollers in which the chain is bonded to the film, as shown in FIG. 4, so that the preprinted film cannot slide. However, this mechanism of chain and pinion may not be needed in some applications, or it may be replaced by any other similar mechanism.

Figure 3:
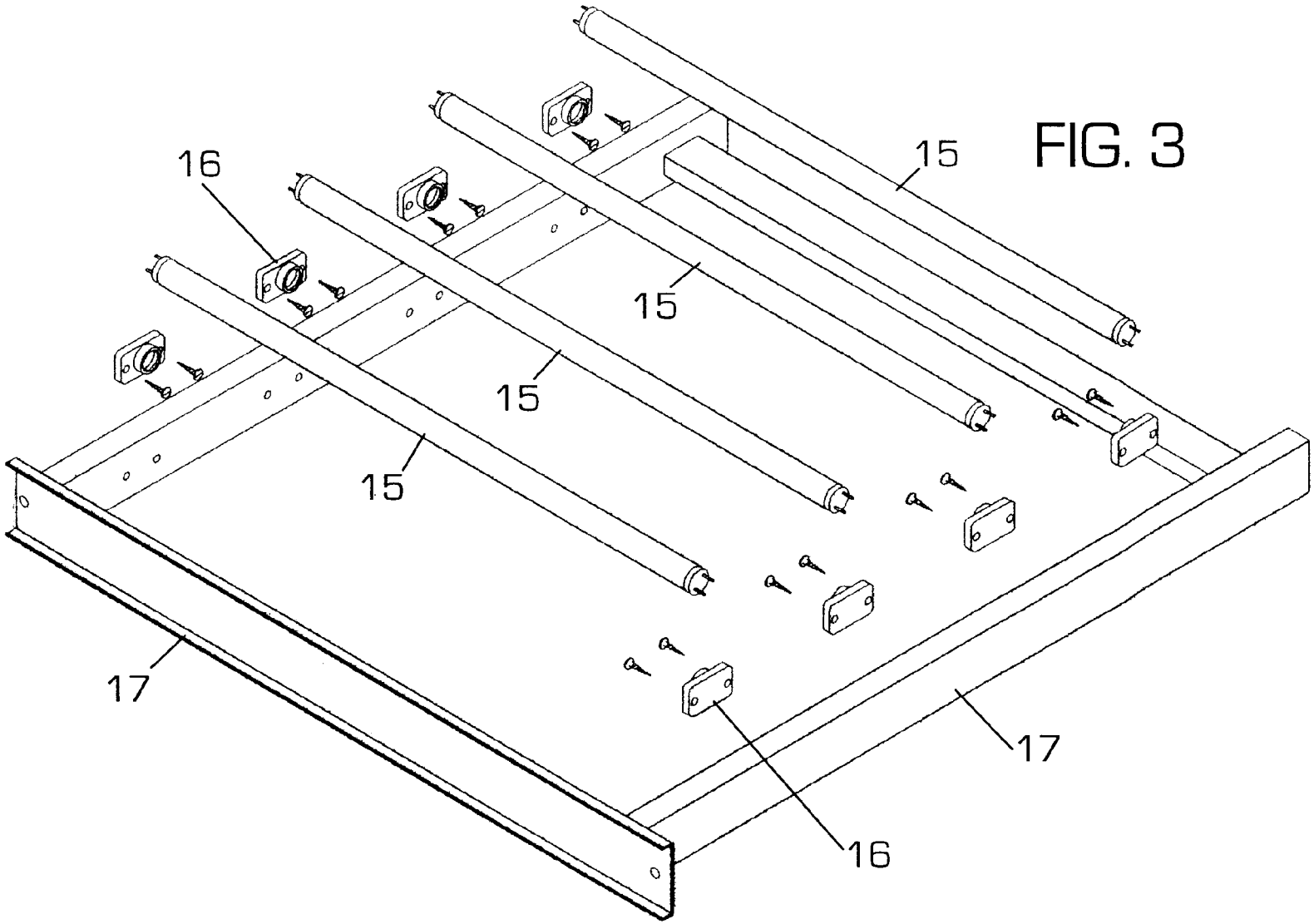
FIG. 3 shows the lamp frame of the preferred embodiment of the invention.
Figure 5:
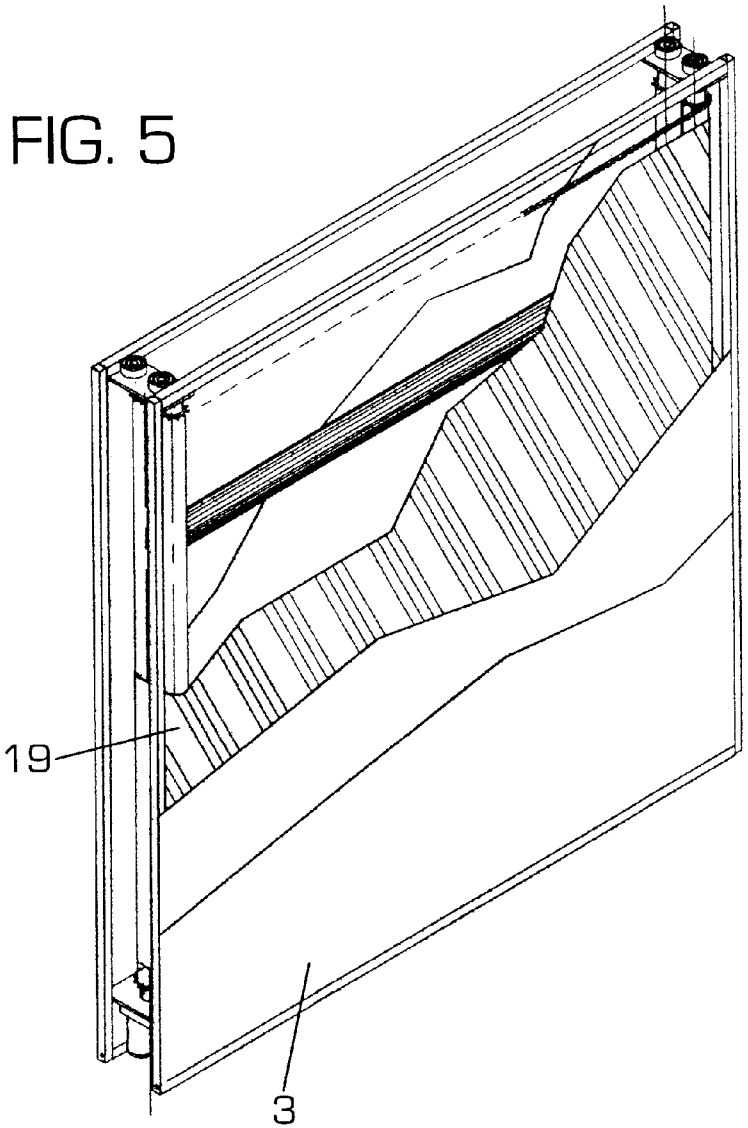
FIG. 5 shows the final assembly of the preferred embodiment of the present invention.

The lamp frame (17) of FIG. 3, allows the mounting of one or more conventional neon tubes (15), on their appropriate sockets (16), or any other luminous source, which, upon mounting inside the preprinted film band as shown in FIGS. 1 and 5, using the guides (10), and the overlapping of the preprinted static film (20), shown in FIG. 5, produces the desired movement effect. Depending on the desired visual effect, the luminous source may be adjusted, in order to change the intensity of the light in some sectors or in the entire luminous sign, at any desired time. This also may be performed by the aid of a computer.

Due to the fact that the luminous source is inside the sign, and that the background and frame of the sign are black, an effect of a floating image is reached when the sign is viewed at night or in a dark space. Such effect could be as real as the pouring of a liquid into a glass, as shown in FIG. 6, and relies solely on the necessary codification of the films' preprinted images, as shown in FIG. 7.

The preprinted films are covered in a translucent protective film (21), and the entire device is finally framed in an ornamental montage, using the acrylic frame elements (4), which impedes the interior light from escaping, and therefore achieves the desired effect.

Figure 6:
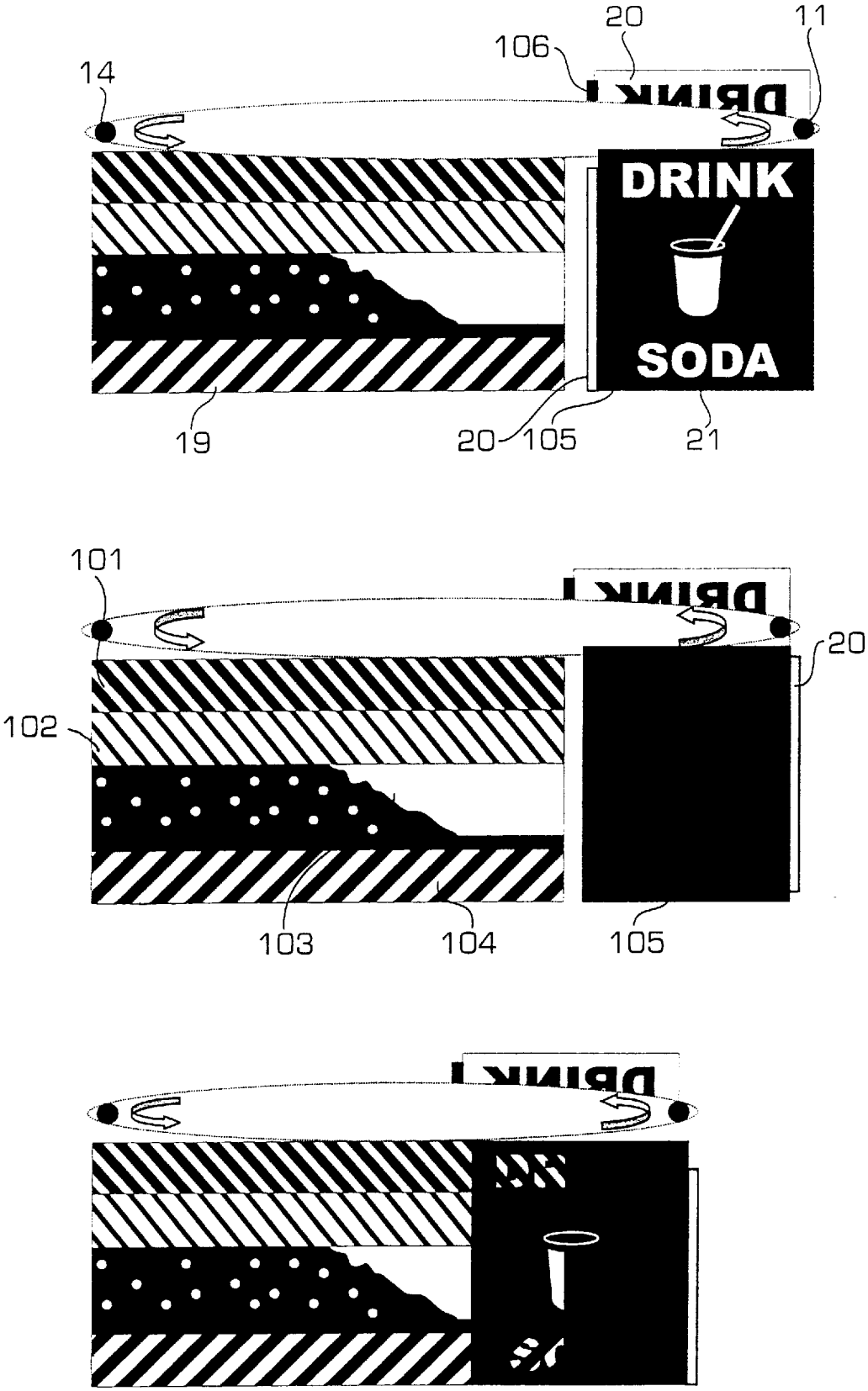
FIG. 6 shows an example of a sequence of images which can be achieved with the preferred embodiment of the present invention.
Figure 7:
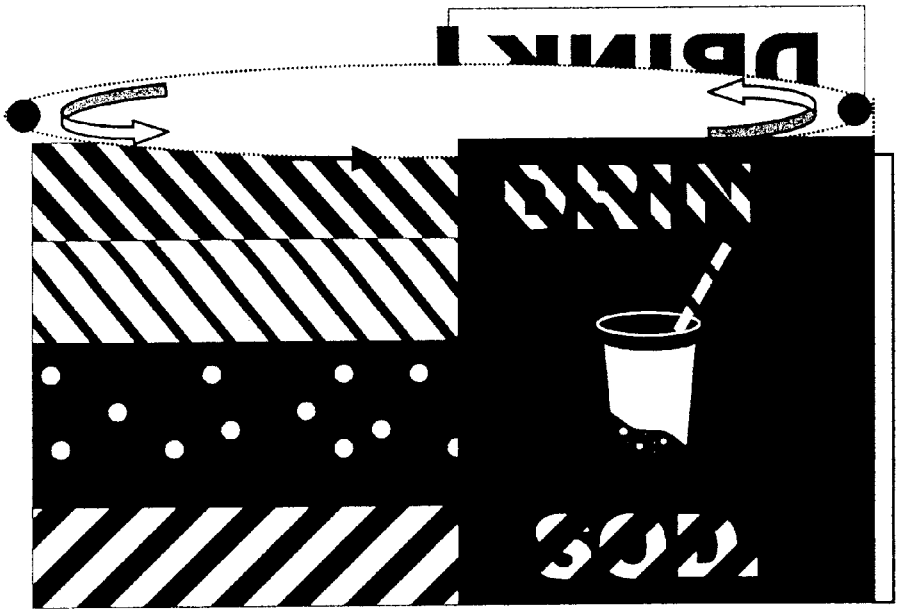
FIG. 7 shows the static film and the moving film with which the effect of FIG. 6 is reached.
Figure 7:
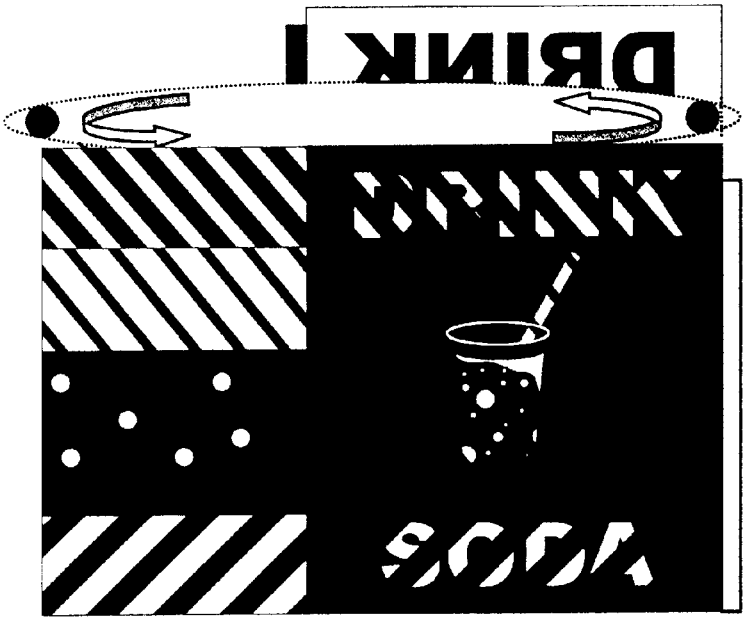

FIG. 7 shows the pattern of the necessary static film, and preprinted film band, with which the desired effect of FIG. 6 is reached.

It is to be noted that the static film is made from a sheet of a translucent plastic material (i.e. acetate, polyvinyl, polyethylene, etc.), and in the preferred embodiment of FIG. 7, the word DRINK, the glass, the straw, and the word SODA, are covered, and a non-translucent black paint is applied to the surface. As a result, only the covered parts of the static film will have translucent properties. After the static film is blacked out, the translucent parts can be painted with translucent inks of different colors, depending on the desired final art.

It is also to be noted that the preprinted film band is made from a sheet of a translucent plastic material (i.e. acetate, polyvinyl, polyethylene, etc.), and in the preferred embodiment of FIG. 7, the preprinted film band is divided longitudinally in 4 zones, the first one will be behind the word DRINK (101), the second will be behind the straw (102), the third will be behind the glass (103), and the fourth will be behind the word SODA (104). The first (101), second (102) and fourth (104) zones are painted in different diagonal patterns and colors, with translucent inks, the third zone (103) is painted with a progressively increasing pattern, using a translucent ink, which produces the effect of the filling of the glass with the soda, when the film band is moving, and in that way, in conjunction with the internal source of light, the final effect is reached.

Figure 8:
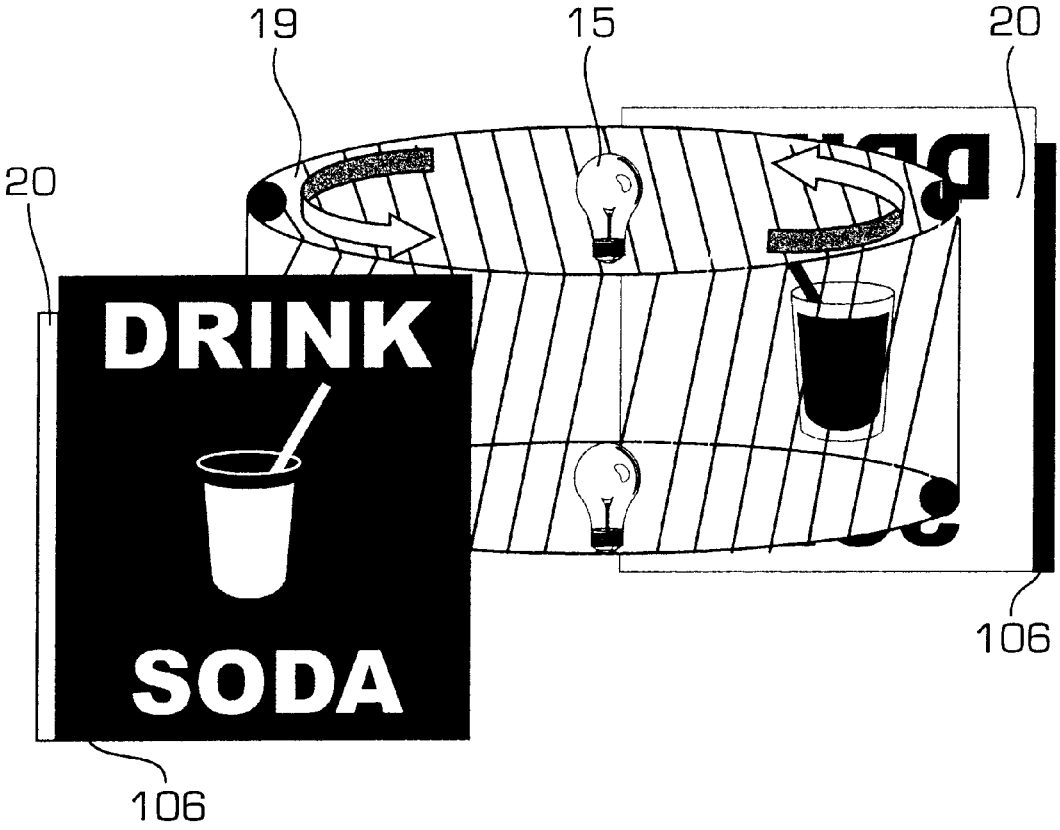
FIG. 8 shows an embodiment in which a second static film is used on a rear face thereof.
Figure 9:
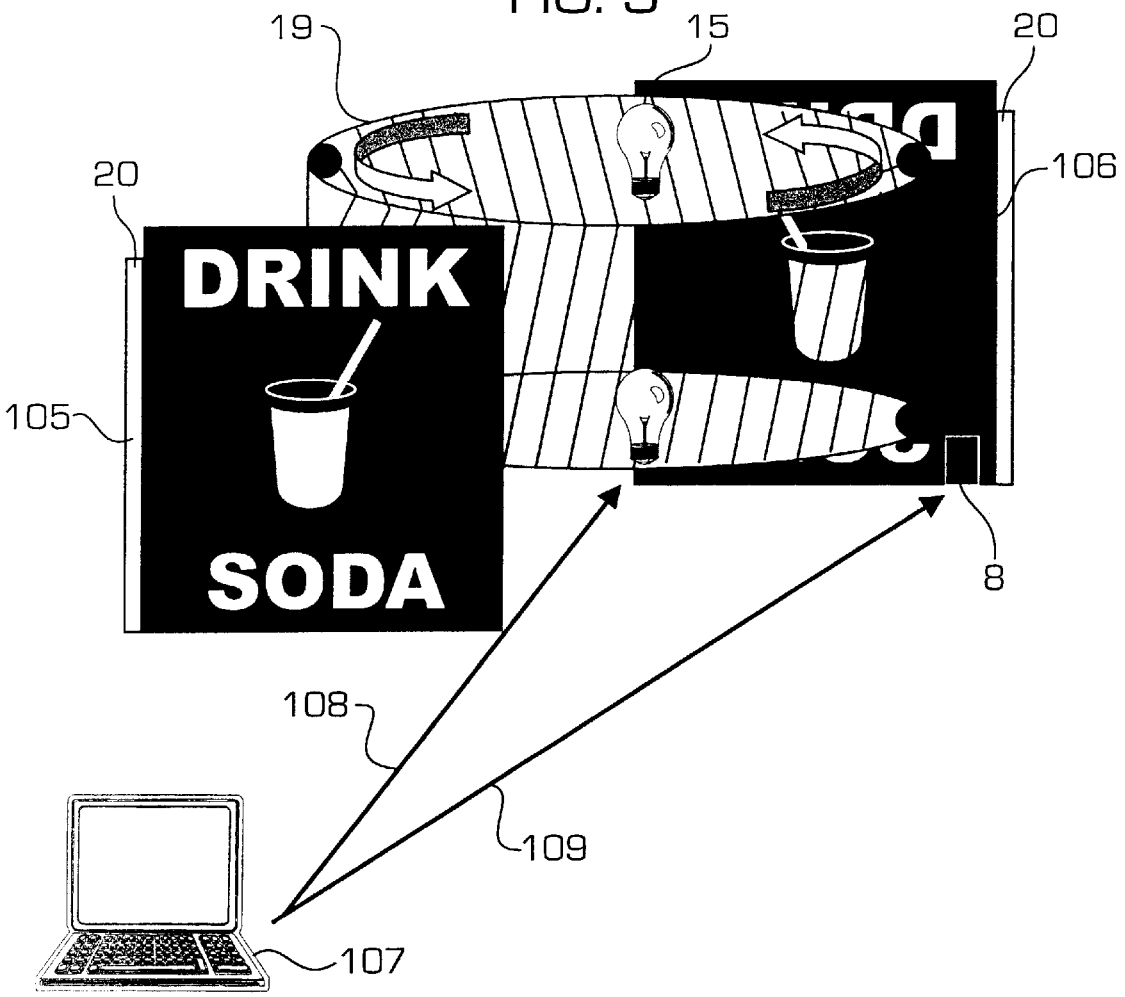
FIG. 9 shows an embodiment in which a second static film is used on a rear face thereof, and in which the sign is regulated by a computer or processor.

If a second static film is used in the rear face (106) as shown in FIG. 8, then the effect can be visualized in both the front (105) and the rear (106) surfaces of the sign.

The present invention is open to various modifications and alternative forms of construction from the preferred embodiment described and shown in the accompanying drawings, and it should be understood that the intention is not to limit the invention to the particular form discussed. To the contrary, the invention should cover all modifications, equivalencies and alternative forms of construction founded in the spirit and scope of the invention as expressed in the following claims.

What is claimed is:

1. A luminous sign producing a sequential variation in a perceived image, the sign comprising:

a support;

a source of illumination, mounted within the support, which source illuminates at least one open face portion of the support from within;

a plurality of rollers, having parallel axes, rotatably mounted on the support, wherein at least one of the rollers is a driven roller;

at least one rotation means, rotatably engaged with at least the driven roller, for rotating the driven roller;

at least one movable preprinted translucent film, operably engaged with the at least one driven roller, such that when the movable translucent film moves, it places an image across the at least one illuminated open face portion of the support, which image moves across the open face portion of the support as the movable translucent film is moved across the illuminated open face portion of the support by rotation of the plurality of rollers;

a frame, mounted on the support outside the plurality of rollers and the movable preprinted translucent film; and at least one static preprinted translucent film, mounted on the frame, having an image over the at least one illuminated open face portion of the support which, when perceived in combination with the image on the movable preprinted translucent film moving across the illuminated open face portion of the support so as to overlap the image on the at least one static preprinted translucent film, produces an effect of real movement of the perceived image.

2. The luminous sign according to claim 1, wherein the rotation means comprises an electric motor.

3. The luminous sign according to claim 2, wherein the electric motor comprises a servomotor.

4. The luminous sign according to claim 1, wherein the movement of the movable preprinted translucent film is controlled by means of a computer.

5. The luminous sign according to claim 1, wherein an intensity of illumination of the illumination source is controlled, so that a change in intensity can be effected over time, or over a portion of the illuminated open face portion.

6. The luminous sign according to claim 5, wherein the intensity of illumination is controlled by a computer.

7. The luminous sign according to claim 1, wherein the luminous sign comprises an open face portion on a front and a rear side thereof.

8. The luminous sign according to claim 1, wherein the luminous sign comprises an open face portion on a front and a rear side thereof, and an open face portion on a left and a right lateral side thereof.

9. The luminous sign according to claim 1, wherein:

the rotation means is an electric motor which is operably engaged with the driven roller;

at least one of the plurality of rollers is provided with pinions; and the at least one movable preprinted translucent film is provided with a chain which is bonded to the film, which chain operably engages the pinions to rotate the moving translucent film about the rollers.

10. The luminous sign according to claim 1, wherein external surfaces of the sign other than the at least one open face portion are black and are opaque to light.

11. The luminous sign according to claim 1, wherein the movable preprinted film is divided into a plurality of zones, which zones are each associated with a corresponding zone of the static preprinted film, such that each of the plurality of zones results in a different image being perceived when the movable preprinted film and the static preprinted film overlap one another.

12. The luminous sign according to claim 1, wherein the image on the at least one static preprinted film is comprised of translucent colors.

13. The luminous sign according to claim 1, wherein the at least one movable preprinted translucent film is polygonal in form.

14. The luminous sign according to claim 1, wherein the at least one static preprinted translucent film is polygonal in form.

15. The luminous sign according to claim 1, wherein the plurality of rollers having parallel axes have axes which are parallel also with a plane of the at least one open face portion of the support.

* * * * *